US009098039B1

(12) United States Patent
Uehara et al.

(10) Patent No.: US 9,098,039 B1
(45) Date of Patent: Aug. 4, 2015

(54) ROLLER-SHAPED ROTATOR, FIXING DEVICE, AND IMAGE FORMING APPARATUS

(71) Applicant: FUJI XEROX CO., LTD., Minato-ku, Tokyo (JP)

(72) Inventors: Yasuhiro Uehara, Kanagawa (JP); Mitsuhiro Matsumoto, Kanagawa (JP); Mikio Saiki, Kanagawa (JP); Kazuyoshi Ito, Kanagawa (JP); Hideaki Ohara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/445,202

(22) Filed: Jul. 29, 2014

(30) Foreign Application Priority Data

Mar. 18, 2014 (JP) ..... 2014-054715

(51) Int. Cl.
*G03G 15/20* (2006.01)

(52) U.S. Cl.
CPC ..... *G03G 15/2089* (2013.01); *G03G 15/2064* (2013.01)

(58) Field of Classification Search
CPC ..... G03G 15/2089; G03G 15/2053; G03G 15/2064
USPC ..... 399/329–331, 333
See application file for complete search history.

(56) References Cited

U.S. PATENT DOCUMENTS

2006/0204295 A1 * 9/2006 Takagi et al. ..... 399/333

FOREIGN PATENT DOCUMENTS

| | | | |
|---|---|---|---|
| JP | 62-014675 | A | 1/1987 |
| JP | 04-044076 | A | 2/1992 |
| JP | 2001-318544 | A | 11/2001 |
| JP | 2005-010249 | A | 1/2005 |
| JP | 2011-145334 | A | 7/2011 |

* cited by examiner

*Primary Examiner* — Hoang Ngo
(74) *Attorney, Agent, or Firm* — Sughrue Mion, PLLC

(57) ABSTRACT

A roller-shaped rotator includes an endless belt and a roller-shaped base member. The roller-shaped base member is formed by winding a thin plate material plural times through elastic deformation into a roller shape. The roller-shaped base member is inserted into the endless belt, and brought into press contact with an inner peripheral surface of the belt by an elastic repulsive force due to the deformation. The roller-shaped base member is supported at both end portions in an axial direction so as to be rotatable about an axis of the roller-shaped base member.

9 Claims, 12 Drawing Sheets

ROLLER-SHAPED ROTATOR, FIXING DEVICE, AND IMAGE FORMING APPARATUS

CROSS-REFERENCE TO RELATED APPLICATIONS

This application is based on and claims priority under 35 USC 119 from Japanese Patent Application No. 2014-054715 filed Mar. 18, 2014.

BACKGROUND (i) Technical Field

The present invention relates to a roller-shaped rotator, a fixing device, and an image forming apparatus.

(ii) Related Art

In an electrophotographic image forming apparatus, a toner is applied to a latent image formed by a difference in electrostatic potential to be visualized, and the formed toner image is transferred to a recording sheet. Then, the toner image is fixed to the recording sheet by a fixing device. As the fixing device, a device which has a heated fixing member and a pressurizing member to be brought into press contact with the fixing member and in which a recording sheet retaining a toner image is interposed between the fixing member and the pressurizing member to be heated and pressurized is widely used. As the fixing member and the pressurizing member, roller-shaped members are used and pressed against each other to be rotationally driven. Besides, use of an endless belt is also proposed.

In order for the fixing device to sufficiently heat and pressurize a recording sheet retaining a toner, it is desired to efficiently heat the fixing member, and to bring the fixing member and the pressurizing member into press contact with each other over a wide range in the circumferential direction. In addition, it is desired to reduce a heat capacity in order to reduce the time required to heat the fixing member to a temperature that enables fixation when starting fixing operation. In order to address such issues, an endless belt is occasionally used as the fixing member or the pressurizing member.

SUMMARY

According to an aspect of the present invention, there is provided a roller-shaped rotator, including: an endless belt; and a roller-shaped base member formed by winding a thin plate material plural times through elastic deformation into a roller shape, the roller-shaped base member being inserted into the endless belt and brought into press contact with an inner peripheral surface of the belt by an elastic repulsive force due to the deformation, in which the roller-shaped base member is supported at both end portions in an axial direction so as to be rotatable about an axis of the roller-shaped base member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

Figure 1:
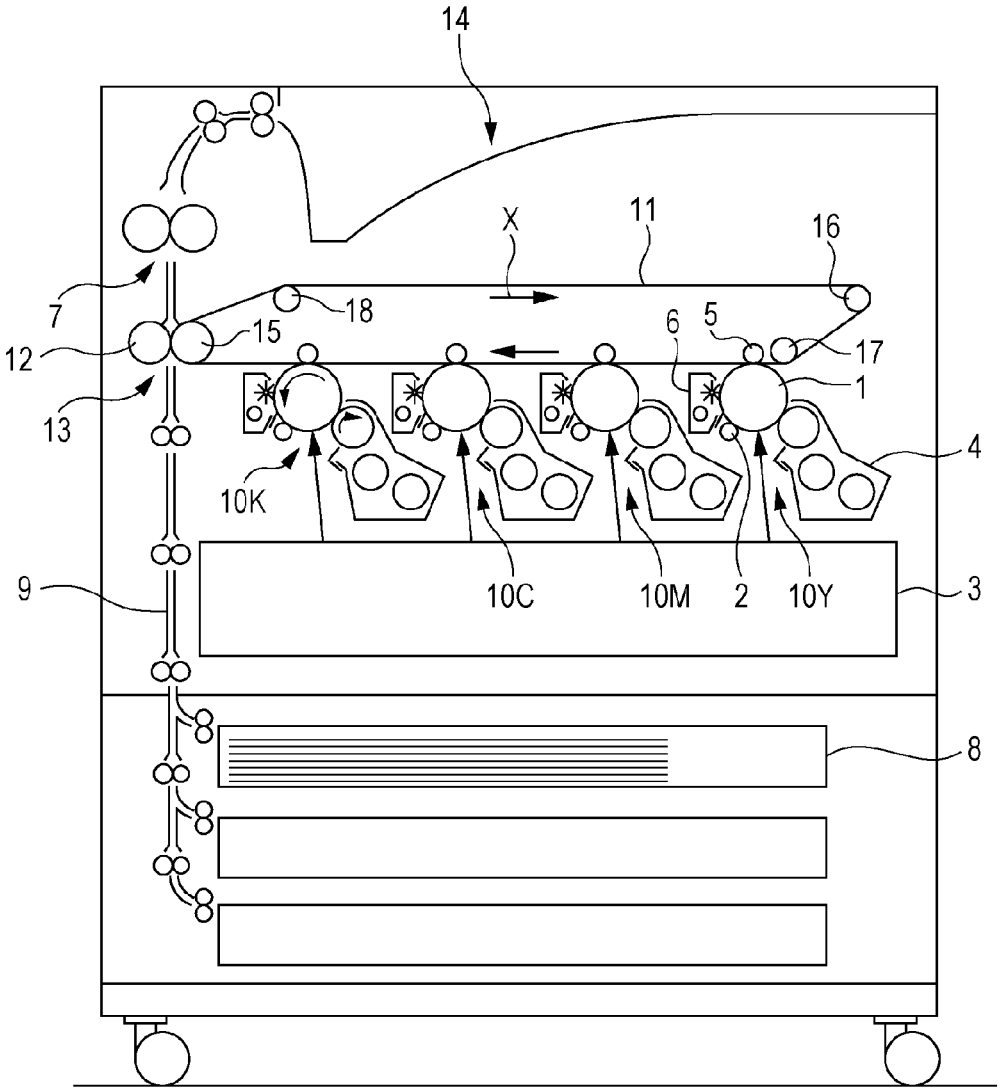
FIG. 1 illustrates a schematic configuration of an image forming apparatus according to an exemplary embodiment of the present invention.

FIG. 1 illustrates a schematic configuration of an image forming apparatus according to an exemplary embodiment of the present invention.

The image forming apparatus form a color image using toners in four colors, and includes electrophotographic image forming units 10Y, 10M, 10C, and 10K that output images in yellow (Y), magenta (M), cyan (C), and black (K) colors, and an intermediate transfer belt 11 that faces the image forming units 10.

The intermediate transfer belt 11 has an endless shape, and is tensely stretched between a rotationally driven counter roller 15, an adjustment roller 16 that adjusts deviation of the intermediate transfer belt 11 in the width direction, and two support rollers 17 and 18. The counter roller 15 is driven to drive the intermediate transfer belt 11 such that the peripheral surface of the intermediate transfer belt 11 circulates in the direction of the arrow X illustrated in the drawing.

The image forming unit 10Y which forms a yellow toner image, the image forming unit 10M which forms a magenta toner image, the image forming unit 10C which forms a cyan toner image, and the image forming unit 10K which forms a black toner image are arranged in this order from the upstream side in the direction of circulation of the intermediate transfer belt 11. A second transfer roller 12 is disposed downstream of the image forming units 10 to contact the intermediate transfer belt 11 and face the counter roller 15. A recording sheet that serves as a recording medium is fed from a recording sheet housing portion 8 to a second transfer position 13, at which the second transfer roller 12 faces the intermediate transfer belt 11, through a transport path 9.

A fixing device 7 is provided downstream of the second transfer position 13 in the transport path for the recording sheet to heat and pressurize the toner images to be applied with pressure onto the recording sheet. A paper ejecting/retaining portion 14 is provided further downstream to retain a stack of recording sheets on which the toner images have been fixed.

Each of the image forming units 10 includes a photosensitive drum 1, and a charging device 2, a developing device 4, a first transfer roller 5, and a cleaning device 6 provided around the photosensitive drum 1. The photosensitive drum 1 functions as an image holding element with an electrostatic latent image formed on the surface of the photosensitive drum 1. The charging device 2 charges the surface of the photosensitive drum 1. The developing device 4 selectively transfers toners to the electrostatic latent image formed on the photosensitive drum 1 to form toner images. The first transfer roller 5 performs a first transfer of the toner images on the photosensitive drum 1 onto the intermediate transfer belt 11. The cleaning device 6 removes toners remaining on the photosensitive drum 1 after the transfer. An exposure device 3 is provided to generate imaging light on the basis of an image signal for each photosensitive drum 1. The imaging light is radiated from the exposure device 3 to each photosensitive drum 1 to write an electrostatic latent image onto the photosensitive drum 1 which has been charged.

The photosensitive drum 1 is formed by placing a photosensitive layer on a conductive metal base member having an endless peripheral surface. The peripheral surface of the photosensitive drum 1 is driven to circulate. The metal base member is electrically grounded. The photosensitive layer is of a functionally separate type in which a charge generating layer and a charge transport layer are sequentially stacked. When the photosensitive layer is irradiated with a laser beam by the exposure device 3 after being charged, the charged potential of the irradiated portion is attenuated.

The developing device 4 uses a two-part developer containing a toner and a magnetic carrier. The developing device 4 transfers the toner to the exposed portion of the surface of the photosensitive drum 1 at a position at which the developing device 4 faces the photosensitive drum 1 to form a toner image as a visual image.

The cleaning device 6 is disposed to face the peripheral surface of the photosensitive drum 1, and includes a cleaning blade supported so as to contact the peripheral surface of the photosensitive drum 1. An edge portion at the distal end of the cleaning blade contacts the surface of the photosensitive drum 1 to remove, or scrape off, the toner etc. remaining on the photosensitive drum 1 after the first transfer.

The second transfer roller 12 is pressed against the counter roller 15 with the intermediate transfer belt 11 interposed between the counter roller 15 and the second transfer roller 12. When the counter roller 15 is rotationally driven, the second transfer roller 12 is driven to rotate. Then, a second transfer voltage is applied between the second transfer roller 12 and the counter roller 15 to form an electric field for transfer. Thus, when a recording sheet is fed between the second transfer roller 12 and the intermediate transfer belt 11, the recording sheet is transported as interposed between the second transfer roller 12 and the intermediate transfer belt 11 so that the toner images on the intermediate transfer belt 11 are transferred onto the recording sheet by the action of the electric field.

Figure 2:
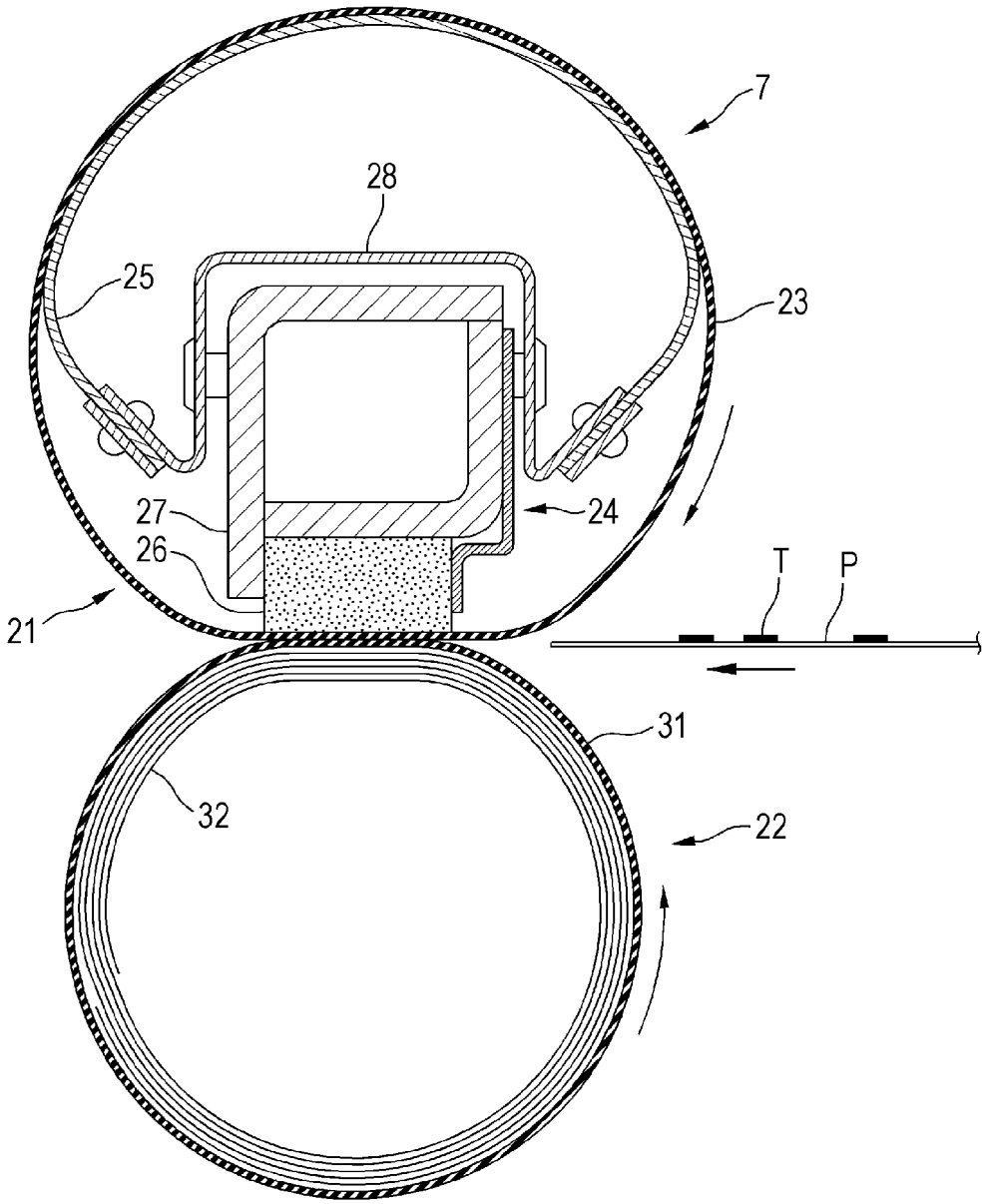
FIG. 2 is a schematic cross-sectional view of a fixing device that may be used in the image forming apparatus illustrated in FIG. 1 according to the exemplary embodiment of the present invention.

FIG. 2 is a schematic cross-sectional view illustrating the fixing device 7.

The fixing device 7 has a fixing member 21 that is brought into press contact with the toner images T on the recording sheet P, and a pressurizing member 22 that is brought into press contact with the fixing member 21. The fixing member 21 includes a fixing belt 23 formed in an endless shape and driven to circulate, and a pressing member 24 disposed inside the endless fixing belt 23 to face the pressurizing member 22 to interpose the fixing belt 23 between the outer peripheral surface of the pressurizing member 22 and the pressing member 24. A heating member 25 in a thin plate shape is provided inside the fixing belt 23. The heating member 25 contacts the inner peripheral surface of the fixing belt 23, and generates heat to heat the fixing belt 23. The pressurizing member 22 is rotationally driven to circulate the fixing belt 23. The recording sheet P to which the toner images have been transferred is fed between the pressurizing member 22 and the fixing belt 23 contacting each other. Then, the toner images T on the recording sheet P are pressed against the fixing belt 23 heated by the heating member 25, and heated and pressurized so that the toner images T are applied with pressure onto the recording sheet P.

The fixing belt 23 is formed from a film-like member having a base layer made of a heat-resistant resin such as polyimide, an elastic member layer made of silicone rubber stacked on the base layer, and a release layer made of a fluorine resin stacked further outside the elastic member layer. The fixing belt 23 is formed in an endless shape with the release layer provided on the outer side. The thicknesses of the base layer, the elastic member layer, and the release layer may be 80 μm, 200 μm, and 30 μm, respectively, for example. When the fixing belt 23 is interposed between the pressurizing member 22 and the pressing member 24, the fixing belt 23 is flexibly deformable. However, when no external force is applied, for example when the fixing belt 23 is supported with the axis extending substantially vertically, the fixing belt 23 has a substantially cylindrical cross-sectional shape because of the rigidity of the film-like member. At this time, the fixing belt 23 may have an outside diameter of 30 mm, for example. In addition, the dimension of the fixing belt 23 in the axial direction, that is, in the width direction of the outer peripheral surface, is larger than the width of the recording sheet P retaining the toner images, and may be 305 mm, for example.

The pressing member 24 has a pressing pad 26 that is pressed against the inner peripheral surface of the fixing belt 23, and a support portion 27 that supports the pressing pad 26.

The pressing pad 26 continuously contacts substantially the entirety of the fixing belt 23 in the width direction, and is elastically deformed to press the fixing belt 23 against the pressurizing member 22. An elastic member having heat resistance such as silicone rubber, for example, may be used as the pressing pad 26.

The support portion 27 has a bar shape obtained by combining members each obtained by bending a metal plate so as to have a substantially L-shaped cross section. The support portion 27 is inserted into the fixing belt 23 in a tubular shape while supporting the pressing pad 26 so as to extend in the axial direction. The support portion 27 is supported at both end portions with a pressing force applied such that the pressing pad 26 is pressed toward the pressurizing member 22. The resultant of forces for pressing the pressing pad 26 toward the pressurizing member 22 may be 150 N, for example.

When the fixing belt 23 is interposed and supported between the pressing member 24 and the pressurizing member 22, the fixing belt 23 is curved and held on the back surface side of a position at which the fixing belt 23 is brought into press contact with the pressurizing member 22, that is, in a path extending from the downstream side to the upstream side of the press contact portion in the driving direction of the fixing belt, and circulates in a tensionlessly stretched state so as to be flexibly deformable.

The heating member 25 is an elastically deformable member in a thin plate shape, and extends continuously in the width direction of the peripheral surface of the fixing belt 23. Both end portions of the heating member 25 in the circumferential direction of the fixing belt 23 are fixed and supported by a holding member 28. The holding member 28 is supported by the support portion 27. The heating member 25 is curved in the circumferential direction. The outer peripheral surface of the heating member 25 is swelled on the back surface side of a region in which the fixing belt 23 is brought into in press contact with the pressurizing member 22 to contact the inner peripheral surface of the fixing belt 23 which circulates in a curved state. Because both the fixing belt 23 and the heating member 25 are flexibly deformable members, the two members compatibly contact each other in a region in which the two members contact each other so as to contact each other in a wide range in the circumferential direction.

The heating member 25 has an insulating layer made of a heat-resistant resin, and a heat generating layer made of stainless steel and stacked on the insulating layer. The heat generating layer is formed in a pattern set such that a required amount of heat is generated by energization. The fixing belt 23 contacts the heating member 25 heated by energizing the heat generating layer to be heated while sliding along the heating member 25. Then, the fixing belt 23 is pressed against the recording sheet P transported to be fed between the pressurizing member 22 and the pressing pad 26.

The pressurizing member 22 is a roller-shaped rotator mainly composed of an endless belt 31 formed from a flexibly deformable film-like member, and a roller-shaped base member 32 formed by winding a metal thin plate material into a roller shape to be inserted into the belt 31.

The belt 31 has a base layer formed as a thin film of stainless steel, an elastic member layer made of silicone rubber stacked on the outer side of the base layer, and a release layer made of a fluorine resin and stacked further on the outer side of the elastic member layer. The thicknesses of the base layer, the elastic member layer, and the release layer may be 50 μm, 200 μm, and 30 μm, respectively, for example. The belt 31 is formed in an endless shape with an inside diameter of 25 mm when shaped to have a circular cross section, and the peripheral surface of the belt 31 has a width of 305 mm.

For the roller-shaped base member 32, a flat plate made of stainless steel and having a thickness of 50 μm is used as the metal thin plate material, and wound into a roller shape, that is, a tubular shape to be inserted into the belt. The roller-shaped base member 32 may be mounted inside the belt 31 as follows.

Figure 3A:
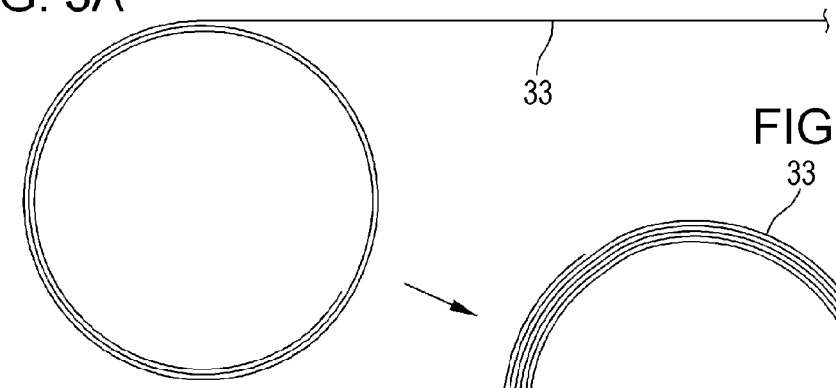
FIGS. 3A to 3D are schematic diagrams illustrating the configuration of a roller-shaped rotator used as a pressurizing member in the fixing device illustrated in FIG. 2.
Figure 3B:
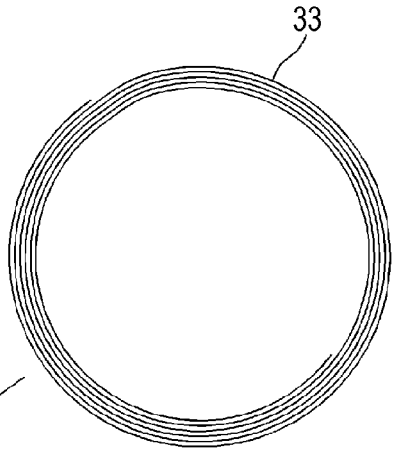
Figure 3C:
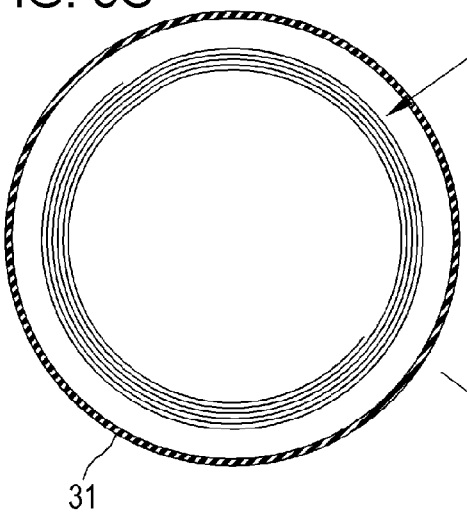
Figure 3D:
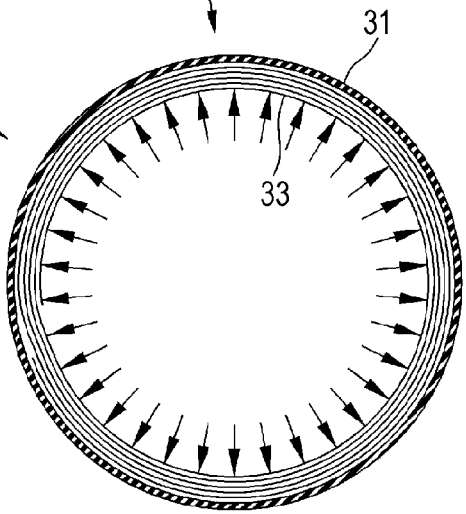

A flat plate formed from a thin plate material 33 made of stainless steel is wound into a tubular shape as illustrated in FIG. 3A, and formed into a roller shape with an outside diameter being smaller than the inside diameter of the belt 31 as illustrated in FIG. 3B. At this time, the thin plate material 33 is elastically deformed to be wound, and inserted into the belt 31 formed in an endless shape as illustrated in FIG. 3C with the wound thin plate material 33 bound so as not to be spread. Then, the wound thin plate material 33 is unbound with both ends of the thin plate material 33 projecting from both side edges of the belt 31 in the width direction of the peripheral surface of the belt 31. The thin plate material 33 exerts an elastic repulsive force to be undeformed, and is spread to increase in outside diameter to be pressed against the inner peripheral surface of the belt 31 as illustrated in FIG. 3D. Consequently, outward press contact forces distributed in the circumferential direction are applied to the inner peripheral surface of the belt 31 to be tensed in the circumferential direction. In the exemplary embodiment, the length of the thin plate material 33 is set such that five layers of the thin plate material 33 are stacked over substantially the entire circumference of the roller-shaped base member 32. The length of the thin plate material 33 formed in a tubular shape in the axial direction is 325 mm.

By combining the belt 31 and the thin plate material 33 wound into a tubular shape in this way, the roller-shaped base member formed by winding the thin plate material 33 into a roller shape and the belt 31 fitted so as to cover the outer peripheral surface of the roller-shaped base member 32 are integrated with each other to form the roller-shaped rotator 22.

Figure 4:
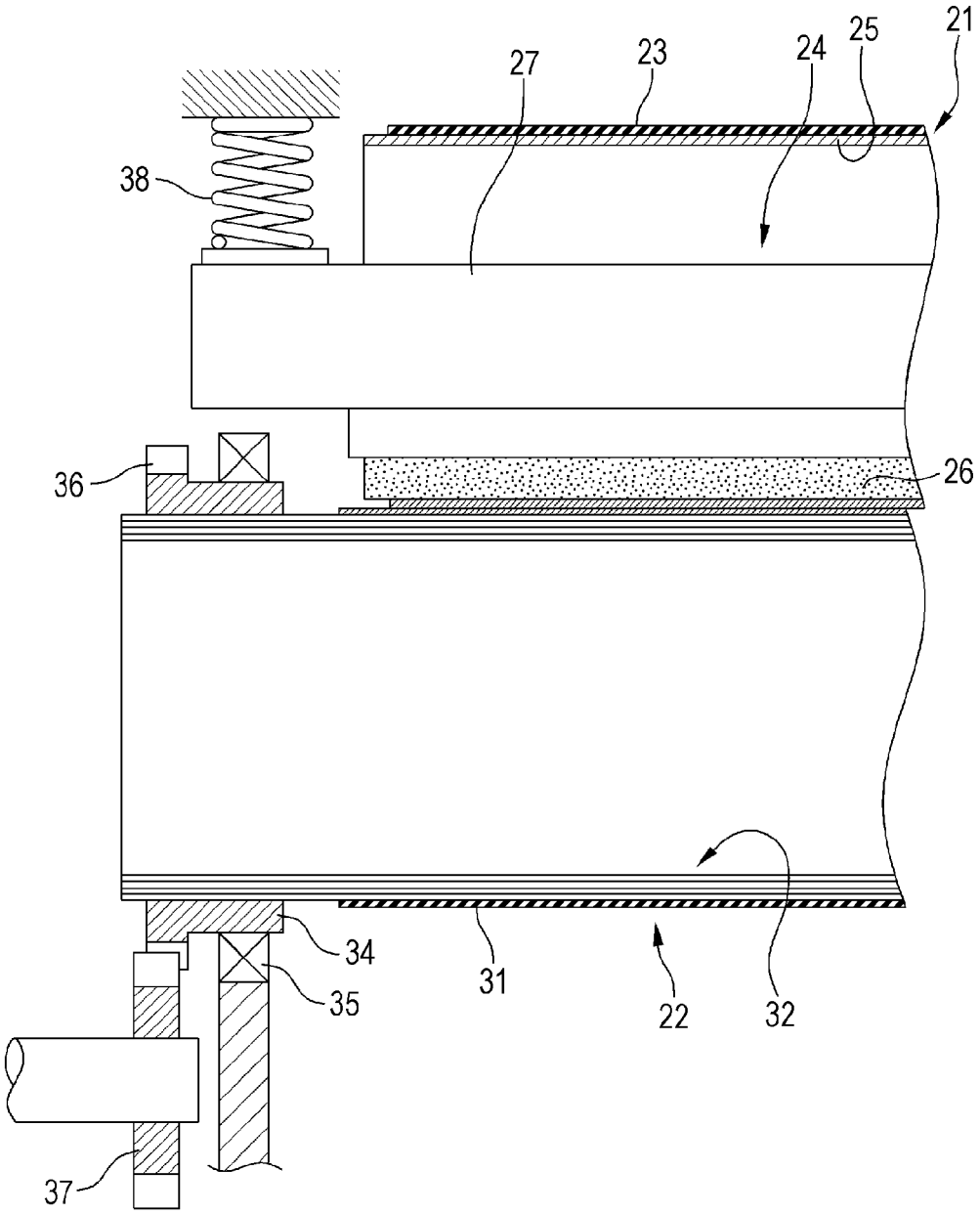
FIG. 4 is a schematic sectional view illustrating a structure for supporting the roller-shaped rotator serving as the pressurizing member and a fixing member of the fixing device illustrated in FIG. 2 at respective end portions in the axial direction.

As illustrated in FIG. 4, the roller-shaped rotator 22 is supported at both end portions in the axial direction so as to be rotatable about the axis, and is brought into press contact with the fixing belt 23.

An annular end portion support member 34 is fitted on the outer side of a portion of the roller-shaped base member 32 that projects from a side edge of the belt 31 at an end portion of the roller-shaped rotator 22 in the axial direction. The annular inner peripheral surface of the end portion support member 34 is formed as a cylindrical curved surface. The inside diameter of the end portion support member 34 is substantially the same as that of the outer peripheral surface of the roller-shaped base member 32 when fitted inside the belt 31. Thus, a press contact force due to an urge of the thin plate material 33 to expand is also applied from the thin plate material 33 to the inner peripheral surface of the end portion support member 34 in addition to the belt 31. The press contact force causes the end portion support member 34 to be fitted with and held by the roller-shaped base member 32.

A bearing 35 is mounted to the outer peripheral surface of the end portion support member 34 to support the roller-shaped base member 32 so as to be rotatable about the axis. In addition, a gear 36 is formed on the outer peripheral surface of the end portion support member 34. A driving gear 37 meshed with the gear 36 is driven by a drive source (not illustrated) to apply a rotational driving force to the end portion support member 34 via the gear 36. The inner peripheral surface of the end portion support member 34 and the outer peripheral surface of the roller-shaped base member 32 are fitted into press contact with each other to transfer a driving force due to a friction force applied between the peripheral surfaces. At this time, the driving direction relative to the direction in which the thin plate material 33 of the roller-shaped base member 32 is wound is set as follows.

Figure 5:
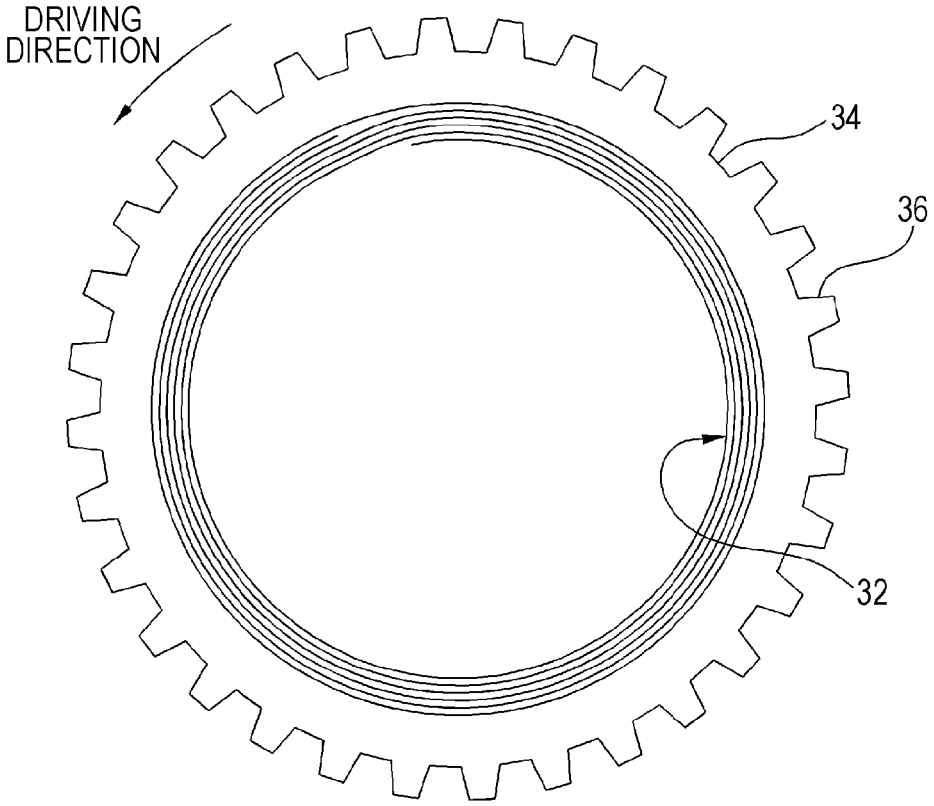
FIG. 5 is a schematic diagram of a portion of the roller-shaped rotator used in the fixing device illustrated in FIG. 2 to which a rotational driving force is applied.

The rotational driving force transferred from the end portion support member 34 to the roller-shaped base member 32 is applied in the direction of releasing elastic deformation of the wound thin plate material 33. That is, as illustrated in FIG. 5, the driving force is applied as a frictional force to the outer peripheral surface of the roller-shaped base member 32, and the direction of the driving force is opposite to the direction in which the thin plate material 33 is wound. This gives an urge to reduce the curvature of the wound thin plate material 33 and increase the outside diameter of the roller-shaped base member 32. Therefore, the roller-shaped base member 32 is strongly pressed against the inner peripheral surface of the end portion support member 34 which binds the outside diameter of the roller-shaped base member 32, increasing the frictional force. The roller-shaped base member 32 is rotationally driven by the frictional force.

In the pressing member 24, as illustrated in FIG. 4, the bar-shaped support portion 27 is inserted into the fixing belt 23, and pressed against the roller-shaped rotator 22 serving as the pressurizing member via springs 38 provided at both end portions. At this time, the bar-shaped support portion 27 is disposed such that the axis of the support portion 27 extends substantially in parallel with the axis of the roller-shaped rotator 22, and the fixing belt 23 is interposed between the pressing pad 26 supported by the support portion 27 and the roller-shaped rotator 22. When a pressing force is applied from the fixing member 21 to the roller-shaped base member 32 in this way, the roller-shaped base member 32 is deformed in cross-sectional shape such that the outer peripheral surface of the roller-shaped base member 32 is pressed inward. Because plural layers of a thin plate material made of stainless steel are stacked in the roller-shaped base member 32 so that the layers are relatively deformable, the roller-shaped base member 32 has low bending rigidity against deformation in cross section, and significantly deformed in cross section compared to a unitary pipe member with a thickness corresponding to that of the plural layers. Consequently, the region over which the outer peripheral surface of the fixing belt 23 and the outer peripheral surface of the belt 31 of the pressurizing member are brought into press contact with each other in the circumferential direction may be set to be wide compared to a roller that is less deformable in cross section. In the exemplary embodiment, the region may be set to about 6 mm to 8 mm.

A rotational driving force is transferred from the end portion support member 34 to drive the roller-shaped base member 32 with the fixing member 21 brought into press contact with the roller-shaped base member 32 so that the roller-shaped base member 32 is deformed in cross section. Then, the belt 31 fitted with the outer peripheral surface of the roller-shaped base member 32 to be tensed is driven to circulate. Further, the fixing belt 23, which is brought into press contact with the belt 31 between the pressing pad 26 and the roller-shaped base member 32, is driven by the belt 31 of the roller-shaped rotator 22 to circulate.

Rotational drive of the roller-shaped base member 32 may be performed not only through friction between the inner peripheral surface of the end portion support member 34 and the outer peripheral surface of the roller-shaped base member 32, but also through engagement of the end portion support member 34 near an outer end edge of the thin plate material 33 constituting the roller-shaped base member 32.

Figure 6A:
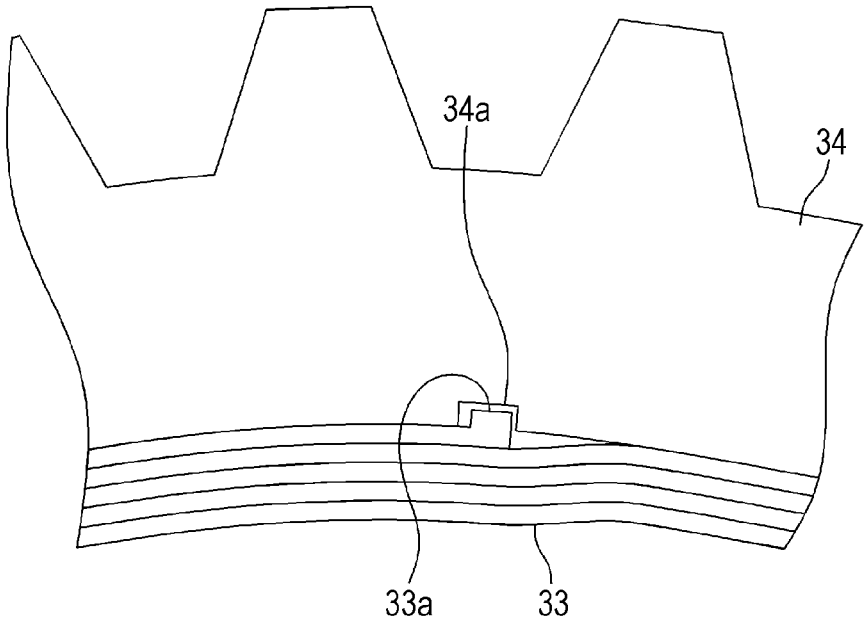
FIGS. 6A and 6B are each an enlarged view illustrating an example of a configuration that may be adopted in a portion for transfer of a rotational driving force from an end portion support member to the roller-shaped rotator used in the fixing device illustrated in FIG. 2.

For example, as illustrated in FIG. 6A, a projecting portion 33*a* is provided to project outward near an end edge of the thin plate material 33 wound in a tubular shape. In addition, a recessed portion 34*a* is provided in the inner side of the end portion support member 34 to accommodate the projecting portion 33*a*. With the projecting portion 33*a* of the thin plate material accommodated in the recessed portion 34*a* of the end portion support member, the projecting portion 33*a* is engaged with the end portion support member 34 when the end portion support member 34 is rotationally driven, and a force in the direction of increasing the diameter of the thin plate material 33 wound in the circumferential direction is applied to the thin plate material 33. Then, the thin plate material 33 is strongly pressed against the inner peripheral surface of the end portion support member 34, which causes a large frictional force. Thus, the roller-shaped base member 32 is not driven by only the force applied from the recessed portion 34*a* of the end portion support member to the projecting portion 33*a* of the thin plate material, but driven without slipping by both the force transferred to the projecting portion 33*a* of the thin plate material and the frictional force between the end portion support member 34 and the roller-shaped base member 32.

Figure 6B:
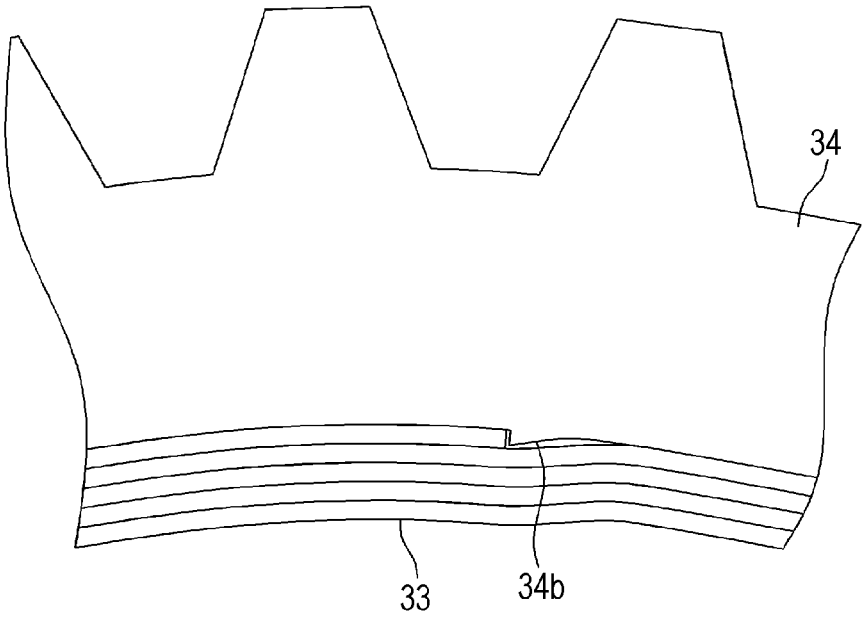

As the structure for engagement of the thin plate material 33 wound in a tubular shape with the end portion support member 34, a projecting portion 34*b* may be provided to project inward from the inner peripheral surface of the end portion support member 34 so that the projecting portion 34*b* is engaged with an end surface of the thin plate material 33 as illustrated in FIG. 6B.

In the image forming apparatus described above, toner images in various colors formed by the image forming units 10 are superposed on the intermediate transfer belt 11 to be collectively transferred onto a recording sheet at a position at which the second transfer roller 12 faces the intermediate transfer belt 11. The recording sheet P is fed to the fixing device 7, and superposed on the fixing belt 23 such that the toner images T retained by the recording sheet P contact the fixing belt 23 to be fed between the roller-shaped rotator 22 serving as the pressurizing member and the fixing belt 23. The fixing belt 23 contacts the heating member 25 which is energized to generate heat, and contacts the recording sheet P with the fixing belt 23 heated. Then, the toner images are pressurized between the roller-shaped rotator 22 and the pressing member 24 to be fixed onto the recording sheet. In addition, the roller-shaped rotator 22 serving as the pressurizing member has the roller-shaped base member 32 formed from a thin plate material made of stainless steel, and has a small heat capacity compared to a roller with an elastic member layer formed around a metal core material, a pressurizing member with a belt tensely stretched between plural rollers etc.

In addition, the roller-shaped base member 32 formed from the thin plate material 33 has a flexibly deformable cross section, and thus the length of a region in the circumferential direction over which the fixing belt 23 and the belt 31 of the roller-shaped rotator 22 serving as the pressurizing member are brought into press contact with each other, or the so-called nip width, may be easily increased. For example, the length of such a region may be set to be equivalent or large compared to a case where a roller with an elastic member layer formed around a metal core material is used as the pressurizing member.

To drive the roller-shaped rotator 22, the belt 31 supported by the single roller-shaped base member 32 is rotatably supported by the bearing 35 together with the roller-shaped base member 32 which is in close contact with the inner peripheral surface of the belt 31.

Figure 7:
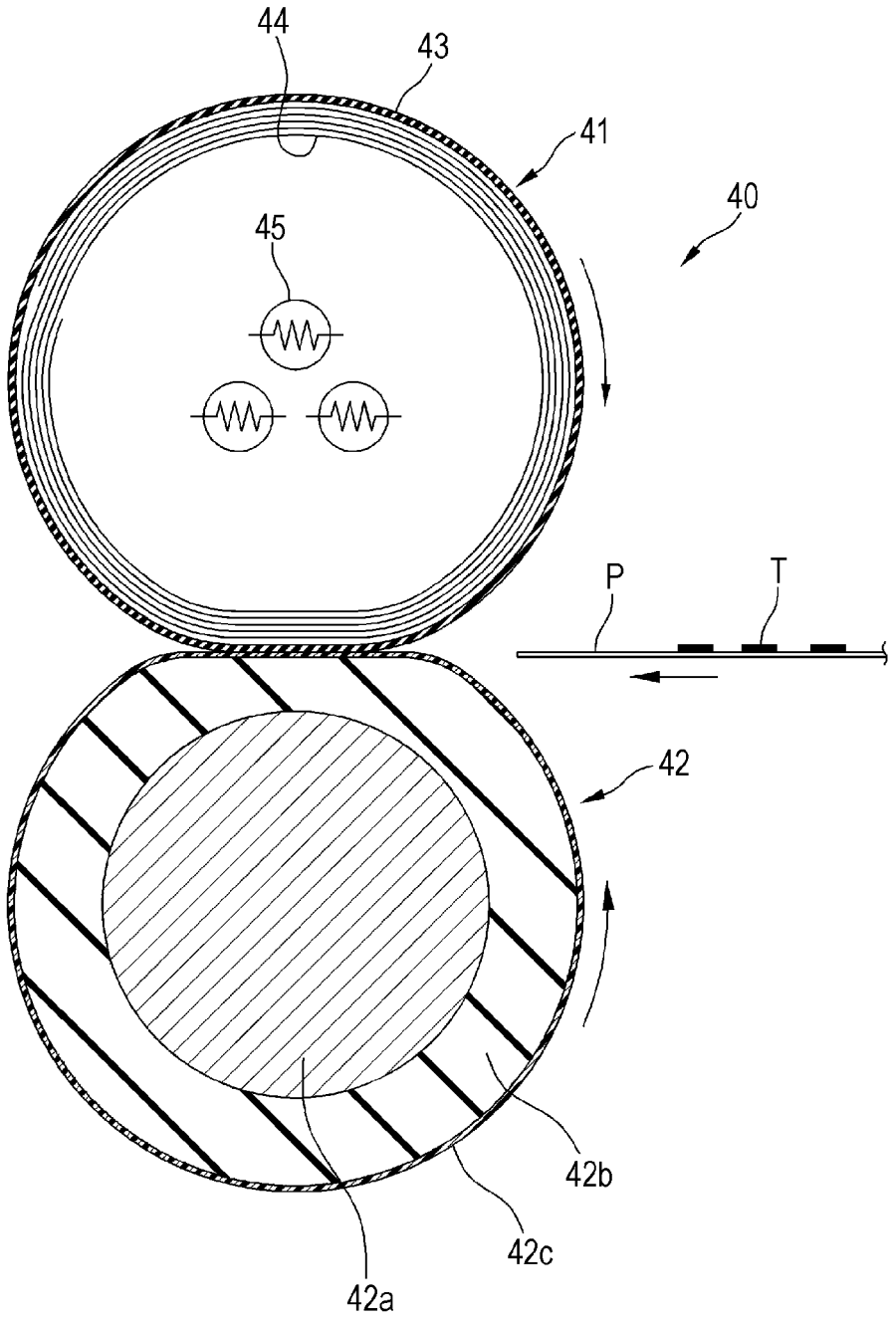
FIG. 7 is a schematic cross-sectional view of a fixing device according to another exemplary embodiment of the present invention.

FIG. 7 is a schematic cross-sectional view illustrating a fixing device according to another exemplary embodiment of the present invention.

In a fixing device 40, a roller-shaped rotator 41 according to the exemplary embodiment of the present invention is used as the fixing member, and a pressurizing roller 42 that serves as the pressurizing member is brought into press contact with the roller-shaped rotator 41 with the respective axes of the two members extending substantially in parallel with each other.

As with the roller-shaped rotator 22 used as the pressurizing member in the fixing device illustrated in FIG. 2, the roller-shaped rotator 41 used as the pressurizing member is mainly composed of an endless fixing belt 43 formed from a flexibly deformable film-like member, and a roller-shaped base member 44 formed by winding a metal thin plate material into a roller shape to be inserted into the belt 43. Halogen lamps 45 are disposed inside the roller-shaped base member 44 to extend along the axial direction to heat the roller-shaped base member 44 and the fixing belt 43.

The fixing belt 43 has a base layer formed as a thin film of stainless steel, an elastic member layer made of silicone rubber stacked on the outer side of the base layer, and a release layer made of a fluorine resin and stacked further on the outer side of the elastic member layer. The thicknesses of the base layer, the elastic member layer, and the release layer may be 50 μm, 200 μm, and 30 μm, respectively, for example. The fixing belt 43 is formed in an endless shape with an inside diameter of 25 mm when shaped to have a circular cross section, and the peripheral surface of the belt 31 has a width of 305 mm.

For the roller-shaped base member 44, a flat plate made of stainless steel and having a thickness of 50 μm is wound into a tubular shape to be inserted into the fixing belt 43. As with the roller-shaped base member 22 used as the pressurizing member in the fixing device 7 illustrated in FIG. 2, the roller-shaped base member 44 is mounted inside the fixing belt 43. The roller-shaped base member 44 is brought into press contact with the inner peripheral surface of the fixing belt 43 by the elastic repulsive force of the flat plate made of stainless steel.

The pressurizing roller 42 includes a metal core material 42*a*, an elastic member layer 42*b* formed on the outer peripheral surface of the core material 42*a*, and a release layer 42*c* stacked on the elastic member layer 42*b*. The elastic member layer 42*b* may be formed from silicone rubber, for example, and may have a thickness of 5 mm, for example. The release layer 42*c* is a fluorine resin layer with a thickness of 30 μm, for example. The pressurizing roller 42 has an outside diameter of 28 mm, and the peripheral surface of the pressurizing roller 42 has a width of 325 mm.

As with the roller-shaped rotator 22 used as the pressurizing member in the fixing device illustrated in FIG. 2, the roller-shaped rotator 41 constituting the fixing member may be supported by fitting end portion support members (not illustrated) with both end portions, in the axial direction, of the roller-shaped base member 44, which is obtained by winding a thin plate material into a tubular shape, and rotatably supporting the end portion support members with bearings. In addition, the core material of the pressurizing roller 42 is supported via bearings.

The roller-shaped rotator 41 and the pressurizing roller 42 may be driven by applying a rotational driving force to a gear attached to the core material of the pressurizing roller 42 to drive the fixing belt 41 in press contact with the outer peripheral surface of the pressurizing roller 42 and the roller-shaped base member 44. However, the roller-shaped base member 44 may be driven directly. That is, the end portion support members fitted with the roller-shaped base member 44 are provided with a gear, and a rotational driving force is transferred to the gear to drive the roller-shaped base member 44 and the fixing belt 43 mounted to the outer side of the roller-shaped base member 44. Then, the pressurizing roller 42 is driven by the roller-shaped rotator 41. As with the roller-shaped base member 32 used as the pressurizing member in the fixing device illustrated in FIG. 2, the roller-shaped base member 44 is driven in the direction of unwinding the thin plate material which has been wound into a tubular shape, that is, in the direction of increasing the outside diameter of the roller-shaped base member 44.

In the fixing device 40, the roller-shaped rotator 41 serving as the fixing member is heated by the halogen lamps 45, and the toner images T on the recording sheet P transported as interposed between the pressurizing roller 42 and the roller-shaped rotator 41 are heated and pressurized so that the toner images are fixed onto the recording sheet P.

In a portion over which the roller-shaped rotator 41 and the pressurizing roller 42 are brought into press contact with each other, the cross sections of both the roller-shaped rotator 41 and the pressurizing roller 42 are deformed to increase the dimension of the region for press contact in the circumferential direction.

Figure 8A:
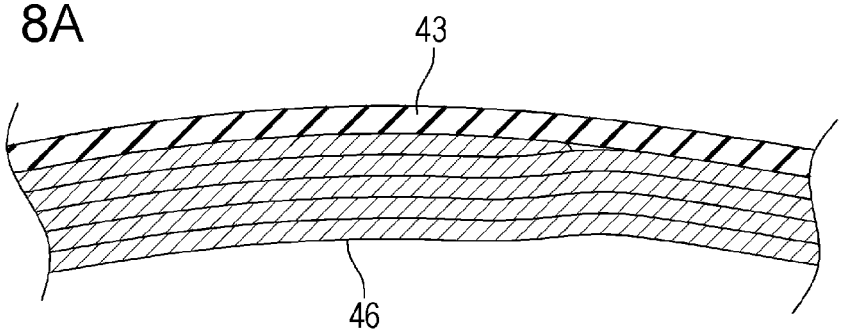
FIGS. 8A and 8B are each an enlarged sectional view illustrating a part of a roller-shaped base member that may be adopted in the fixing device illustrated in FIG. 7.

If the roller-shaped rotator 41 according to the exemplary embodiment of the present invention is used as the fixing member as described above, there is a bump on the peripheral surface of the roller-shaped base member 44 at an end edge, in the circumferential direction, of the thin plate material wound into a tubular shape. Such a bump may affect fixation of the toner images onto the recording sheet. That is, the press contact force applied to the recording sheet is abruptly varied in the circumferential direction by the bump, which may easily cause a failure in fixation of the toner images. As illustrated in FIG. 8A, in the roller-shaped rotator 41 according to the exemplary embodiment of the present invention, in order to address such an issue, a portion of a thin plate material 46, which is wound into a tubular shape, near the outer end edge may have a thickness that gradually reduces toward the distal end of the thin plate material 46.

Figure 8B:
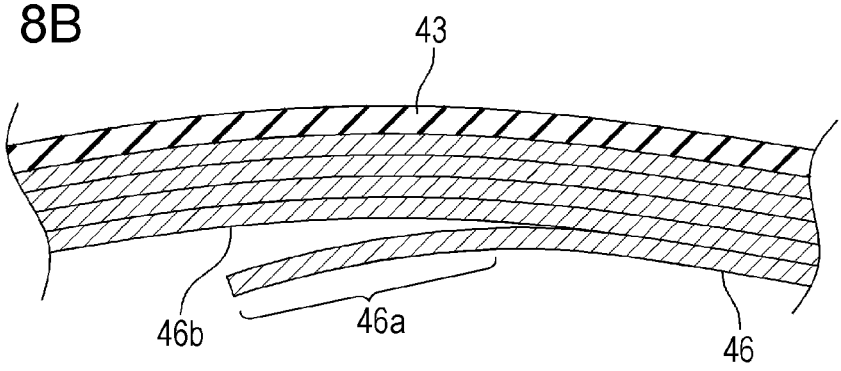

Meanwhile, it is conceivable that the rigidity of the roller-shaped base member is abruptly varied in the circumferential direction to affect the toner images to be fixed at the position of the inner end edge of the thin plate material. However, as illustrated in FIG. 8B, a portion 46*a* of the thin plate material 46 near the inner end edge may be curved in advance to extend gradually away from portions 46*b* of the thin plate material stacked on the inner side of the portion 46*a* when the thin plate material 46 is wound.

In order to suppress occurrence of a failure in fixation of the toner images at the position of an end edge of the thin plate material, an elastic member layer may be interposed between the fixing belt 43 and the roller-shaped base member 44 to suppress occurrence of a difference in press contact force between the fixing belt 43 and the recording sheet. The elastic member layer may be stacked on the inner peripheral surface of the fixing belt. If such processing is difficult, however, the elastic member layer may be interposed as follows.

Figure 9:
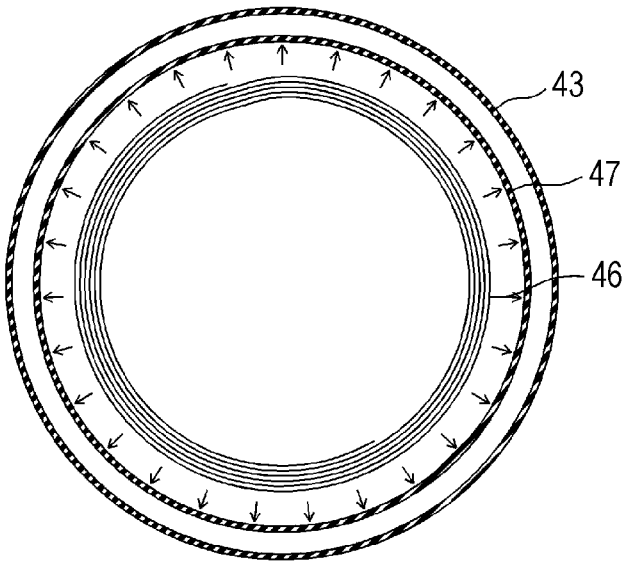
FIG. 9 is a schematic diagram illustrating an example of a method of manufacturing a roller-shaped rotator that may be adopted in the fixing device illustrated in FIG. 7.

As illustrated in FIG. 9, an endless elastic belt 47 that is shorted in circumferential length than the fixing belt 43 is formed from an elastic body having heat resistance such as silicone rubber, for example, separately from the fixing belt 43. The elastic belt 47 is inserted into the fixing belt 43. Further, the thin plate material 46 elastically deformed to be wound into a tubular shape is inserted into the elastic belt 47, and released from the wound and bound state. Consequently, the outside diameter of the thin plate material 46 which has been wound is increased by the elastic repulsive force of the thin plate material 46, and the thin plate material 46 is brought into press contact with the inner side of the elastic belt 47 to increase the diameter of the elastic belt 47. Then, the outer peripheral surface of the elastic belt 47 is pressed against the inner peripheral surface of the fixing belt 43 to obtain a roller-shaped rotator in which the fixing belt 43 and the roller-shaped base member 44 formed from the thin plate material 46 are brought into press contact with each other via the elastic belt 47.

When the roller-shaped rotator according to the exemplary embodiment of the present invention is used as the pressurizing member as in the fixing device illustrated in FIG. 2, the roller-shaped rotator abuts on the back surface side of the recording sheet retaining the toner images, and thus an end edge of the thin plate material exerts little effect on fixation of the toner images. If there is a possibility of occurrence of a failure in fixation of the toner images, however, the thin plate material of the roller-shaped rotator used as the pressurizing member may be processed as described above, or an elastic member layer may be interposed between the roller-shaped base member and the belt.

Figure 10:
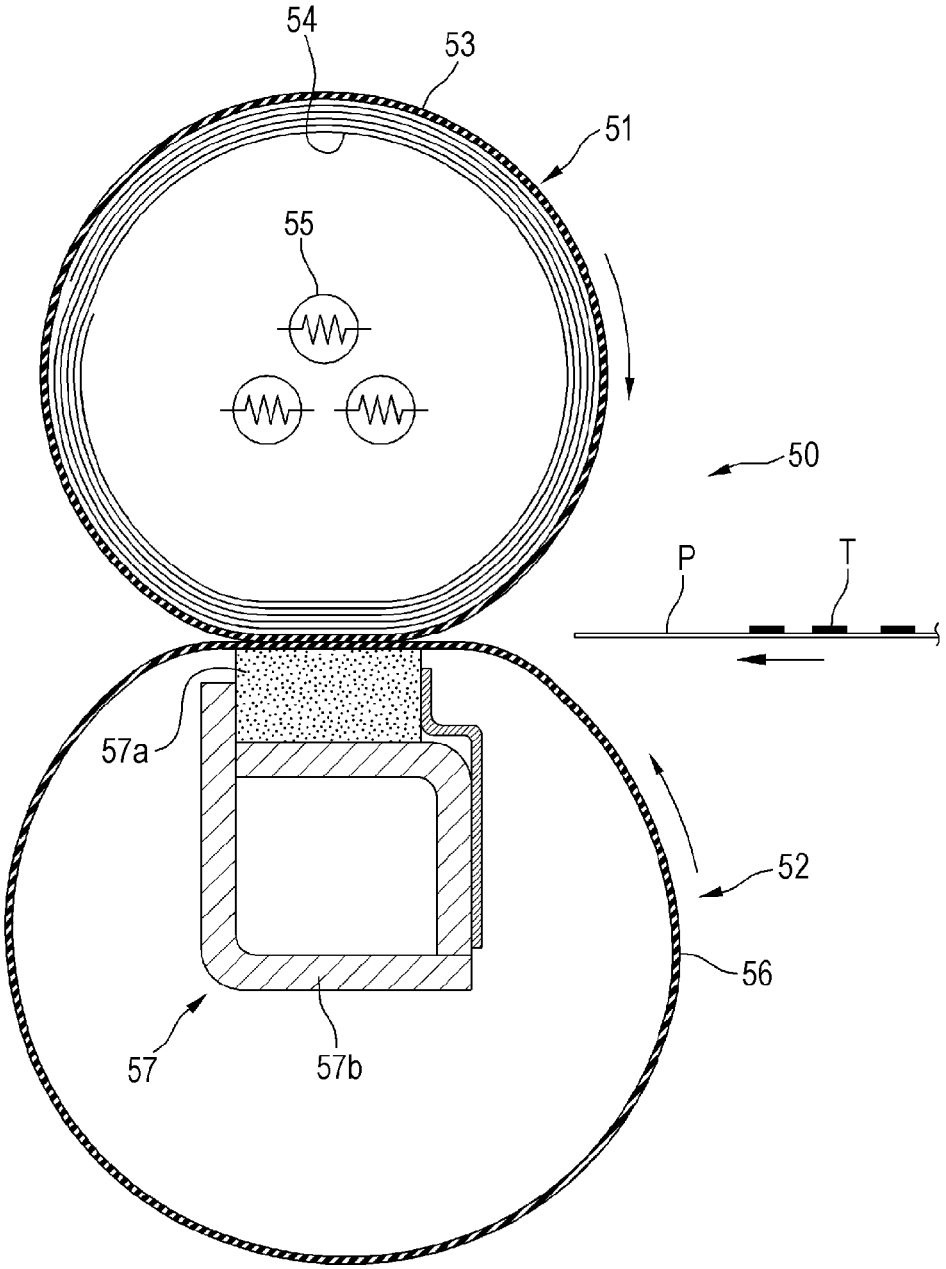
FIG. 10 is a schematic cross-sectional view of a fixing device according to another exemplary embodiment of the present invention.

FIG. 10 is a schematic cross-sectional view illustrating a fixing device according to another exemplary embodiment of the present invention.

In a fixing device 50, a roller-shaped rotator according to an exemplary embodiment of the present invention is used as the fixing member, and a belt that circulates in a tensionlessly stretched state is used as the pressurizing member.

A roller-shaped rotator 51 used as the fixing member in the fixing device 50 has the same configuration as that of the roller-shaped rotator 41 used in the fixing device 40 illustrated in FIG. 7, and both end portions of a roller-shaped base member 54 are rotatably supported via end portion support members (not illustrated). A rotational driving force is applied to the roller-shaped base member 54 through the end portion support member mounted to one end portion of the roller-shaped base member 54. In addition, halogen lamps 55 are disposed inside the roller-shaped base member 54 to heat the roller-shaped base member 54 and a fixing belt 53.

A fixing member 52 has a pressurizing belt 56 formed in an endless shape, and a pressing member 57 disposed inside the pressurizing belt 56 to interpose the pressurizing belt 56 between the outer peripheral surface of the roller-shaped rotator 51 serving as the fixing member and the pressing member 57. The pressing member 57 has a pressing pad 57*a* that is pressed against the inner peripheral surface of the pressurizing belt 56, and a support portion 57*b* that supports the pressing pad 57*a*. The support portion 57*b* is supported at both end portions, and pressed against the roller-shaped rotator 51 with a force of 150 N, for example. The pressing pad 57*a* and the support portion 57*b* may be the same in configuration as those of the pressing member 24 which presses the fixing belt 23 against the pressurizing member 22 in the fixing device illustrated in FIG. 2.

The image forming apparatus, the fixing device, and the roller-shaped rotator described above are exemplary embodiments of the present invention, and the present invention is not limited to such exemplary embodiments.

For example, the material, dimension, etc. of the belt and the thin plate material constituting the roller-shaped rotator may be determined as appropriate, and the number of windings of the thin plate material, that is, the number of layers of the thin plate material wound to obtain the roller-shaped base member, may be determined as appropriate in accordance with the diameter of the roller-shaped rotator, the thickness of the thin plate material, and so forth.

Figure 11B:
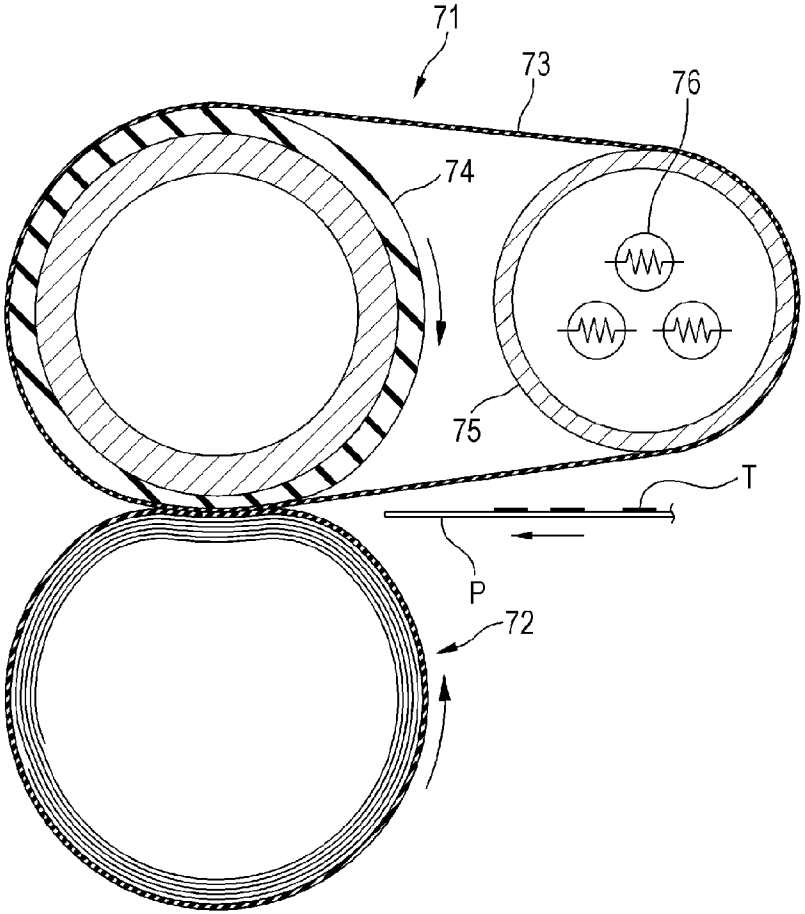
FIGS. 11A and 11B are each a schematic cross-sectional view of a fixing device according to another exemplary embodiment of the present invention.
Figure 11A:
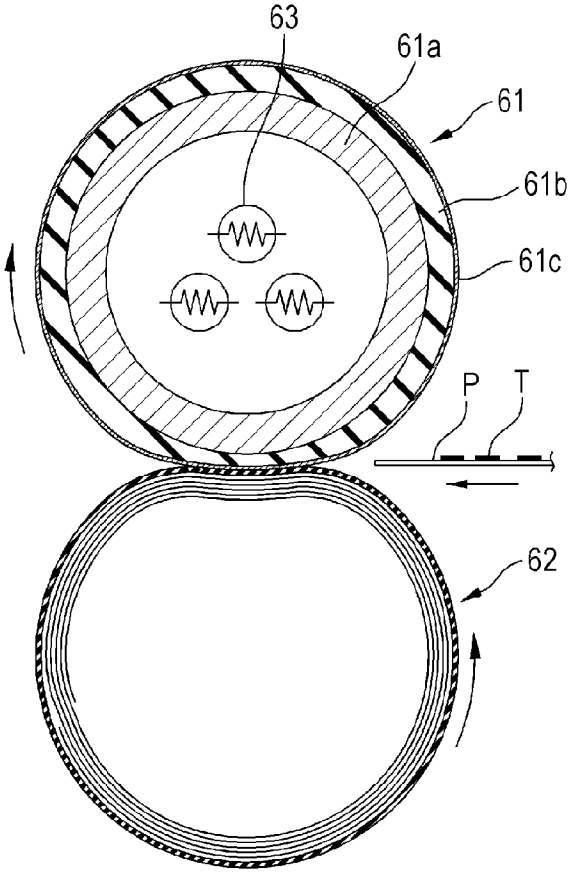

In a fixing device in which a roller-shaped rotator according to an exemplary embodiment of the present invention is used as the pressurizing member, as illustrated in FIG. 11A, the fixing member may be a fixing roller 61 having a metal core material. The fixing roller 61 includes a metal core material 61*a*, an elastic member layer 61*b* stacked on the outer peripheral surface of the core material 61*a*, and a release layer 61*c* formed further on the elastic member layer 61*b*. Halogen lamps 63 are provided inside the metal core material 61*a* as the heating member. The fixing roller 61 is brought into press contact with a roller-shaped rotator 62 that serves as the pressurizing member. A recording sheet that retains toner images is fed between the fixing roller 61 and the roller-shaped rotator 62.

In addition, as illustrated in FIG. 11B, a fixing member 71 may have plural rollers 74 and 75 and a fixing belt 73 tensely stretched between the rollers 74 and 75. The number, position, etc. of the rollers may be determined as appropriate. A pad or the like that frictionally slides against the fixing belt 73 may be used in place of some of the rollers or in addition to the rollers. The fixing belt 73 may be pressed against a roller-shaped rotator 72 serving as the pressurizing member at a position at which the fixing belt 73 is wound around the roller 74 or a pad, or at a position at which the fixing belt 73 is tensely stretched between the rollers or the like. The unit that heats the fixing belt 73 is not limited to halogen lamps 76 as illustrated in FIG. 11B, and any unit capable of heating the fixing belt 73, such as a unit that uses a thin-plate heating member or a unit that heats through electromagnetic induction a fixing belt including a conductive layer, may be adopted as appropriate.

Figure 12B:
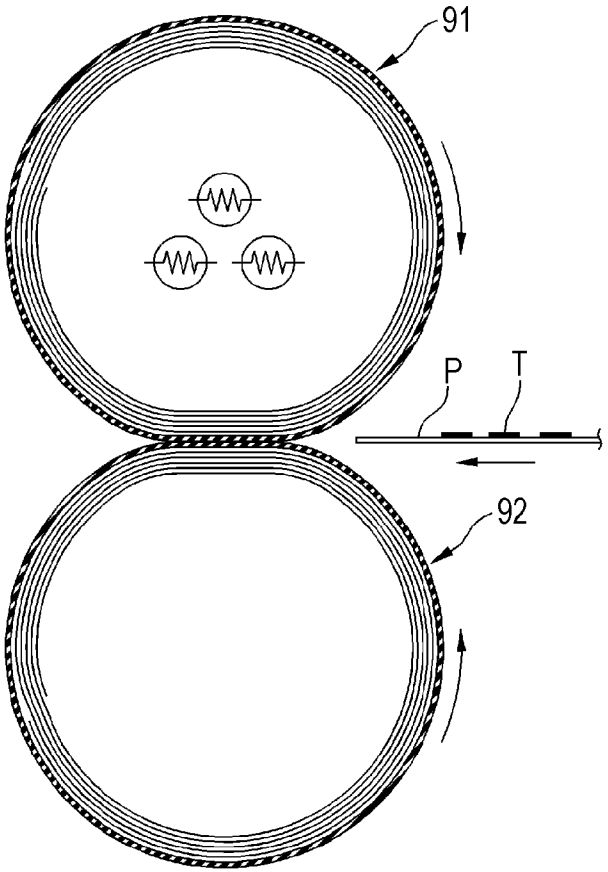
FIGS. 12A and 12B are each a schematic cross-sectional view of a fixing device according to another exemplary embodiment of the present invention.
Figure 12A:
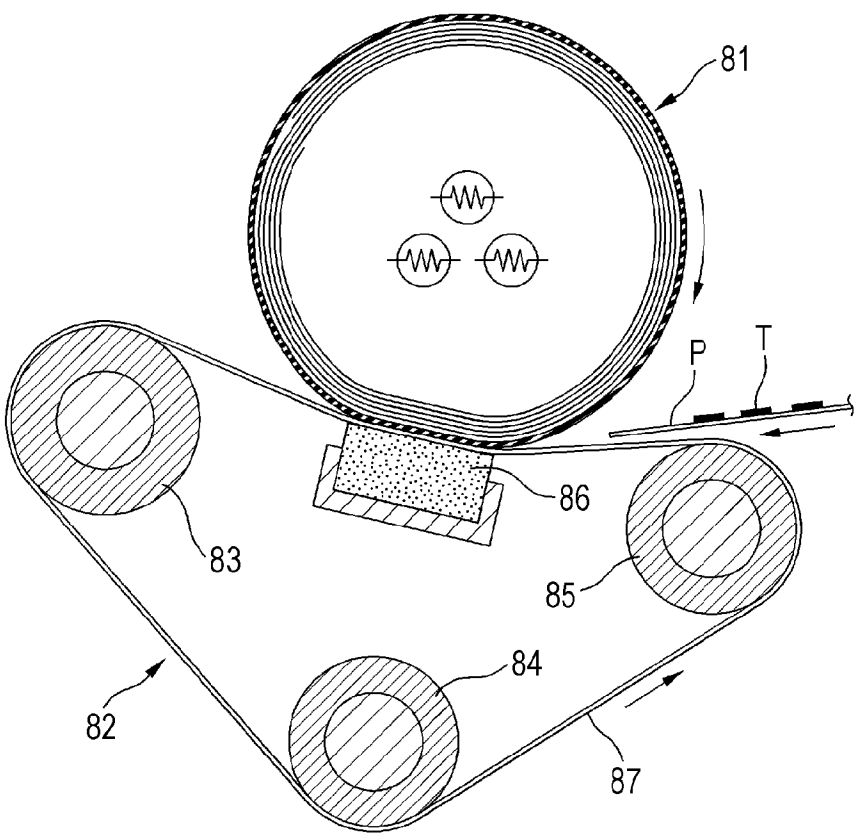

In a fixing device in which a roller-shaped rotator according to an exemplary embodiment of the present invention is used as the fixing member, as illustrated in FIG. 12A, a heating member 82 may include plural rollers 83, 84, and 85, a pad 86 or the like, and a pressurizing belt 87 tensely stretched between the rollers etc. The number, arrangement, etc. of the rollers etc. may be determined as appropriate. As illustrated in FIG. 12A, the pressurizing belt 87 may be pressed against a roller-shaped rotator 81 by the pad 86, or may be pressed against the roller-shaped rotator by the tension of the pressurizing belt.

In addition, as illustrated in FIG. 12B, both a fixing member 91 and a pressurizing member 92 may be roller-shaped rotators according to an exemplary embodiment of the present invention. In such a fixing device, one of the fixing member and the pressurizing member is driven. For the driven member, as with the pressurizing member 22 of the fixing device illustrated in FIG. 2, an end portion support member is fitted on the outer side of an end portion of a roller-shaped base member to be supported and driven. The other roller-shaped rotator may be rotatably supported inside a roller-shaped base member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roller-shaped rotator comprising:

an endless belt; and a roller-shaped base member formed by winding a thin plate material a plurality of times through elastic deformation into a roller shape, the roller-shaped base member being inserted into the endless belt and brought into press contact with an inner peripheral surface of the belt by an elastic repulsive force due to the deformation, wherein the roller-shaped base member is supported at both end portions in an axial direction so as to be rotatable about an axis of the roller-shaped base member.

2. The roller-shaped rotator according to claim 1, wherein an end portion of the roller-shaped base member is inserted into an annular end portion support member, and brought into press contact with an inner peripheral surface of the end portion support member by the elastic repulsive force due to the deformation, and the end portion support member is supported so as to be rotatable in a circumferential direction.

3. The roller-shaped rotator according to claim 1, wherein a gear is formed on the end portion support member along a circumferential direction, and a rotational driving force is applied to the gear, and the rotational driving force is transferred to an outer peripheral surface of the roller-shaped base member wound into a roller shape, and applied in a direction of releasing the elastic deformation.

4. A fixing device comprising:

a fixing member including an endless peripheral surface and supported so as to be movable in a circumferential direction of the peripheral surface, the fixing member being configured such that at least an outer peripheral surface of the fixing member is heated; and a pressurizing member including an endless peripheral surface and supported so as to be movable in a circumferential direction of the peripheral surface, the pressurizing member being configured such that an outer peripheral surface of the pressurizing member is brought into press contact with the outer peripheral surface of the fixing member, and the pressurizing member allowing a recording sheet retaining a toner image to pass between the fixing member and the pressurizing member, wherein the pressurizing member is the roller-shaped rotator according to claim 1.

5. The fixing device according to claim 4, wherein the roller-shaped rotator is pressed against the pressurizing member such that an outer peripheral surface of the roller-shaped rotator is elastically deformed in shape in a circumferential direction to be partially flat or recessed in a portion of the roller-shaped rotator brought into press contact with the pressurizing member.

6. The fixing device according to claim 4, wherein an end portion, on an outer side in a circumferential direction, of the thin plate material constituting the roller-shaped base member has a thickness that gradually reduces toward an end edge.

7. The fixing device according to claim 4, wherein the roller-shaped rotator has an elastic member layer provided between the belt and the roller-shaped base member and having an elastic modulus that is lower than that of a material constituting the roller-shaped base member.

8. An image forming apparatus comprising:

an image holding element with an endless peripheral surface on which an electrostatic latent image is to be formed;

a developing device that transfers a toner to the electrostatic latent image to develop the electrostatic latent image;

a transfer unit that transfers the toner image formed on the image holding element to a recording sheet; and the fixing device according to claim 4 which fixes the toner image transferred onto the recording sheet.

9. A fixing device comprising:

a fixing member including an endless peripheral surface and supported so as to be movable in a circumferential direction of the peripheral surface, the fixing member being configured such that at least an outer peripheral surface of the fixing member is heated; and a pressurizing member including an endless peripheral surface and supported so as to be movable in a circumferential direction of the peripheral surface, the pressurizing member being configured such that an outer peripheral surface of the pressurizing member is brought into press contact with the outer peripheral surface of the fixing member, and the pressurizing member allowing a recording sheet retaining a toner image to pass between the fixing member and the pressurizing member, wherein the fixing member is the roller-shaped rotator according to claim 1.

* * * * *